US010857798B2

(12) United States Patent
McConville et al.

(10) Patent No.: US 10,857,798 B2
(45) Date of Patent: Dec. 8, 2020

(54) CAP AND EVAPORATIVE DEVICES STABILIZING INK IN NOZZLES OF INKJET PRINTHEADS

(71) Applicant: Xerox Corporation, Norwalk, CT (US)

(72) Inventors: Paul J. McConville, Webster, NY (US); Jason M. LeFevre, Penfield, NY (US); Michael J. Levy, Webster, NY (US); Seemit Praharaj, Webster, NY (US); Chu-heng Liu, Penfield, NY (US); David A. VanKouwenberg, Avon, NY (US); Linn C. Hoover, Webster, NY (US); Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/272,086

(22) Filed: Feb. 11, 2019

(65) Prior Publication Data

US 2020/0254765 A1 Aug. 13, 2020

(51) Int. Cl.
*B41J 2/165* (2006.01)
*B41J 2/21* (2006.01)

(52) U.S. Cl.
CPC ..... *B41J 2/16505* (2013.01); *B41J 2/16552* (2013.01); *B41J 2/16547* (2013.01); *B41J 2/2107* (2013.01); *B41J 2002/16502* (2013.01)

(58) Field of Classification Search
CPC ..... B41J 2/16505; B41J 2/16552; B41J 2/16547; B41J 2/2107; B41J 2002/16502
See application file for complete search history.

(56) References Cited

U.S. PATENT DOCUMENTS

| | | | |
|---|---|---|---|
| 4,296,418 | A | 10/1981 | Yamazaki et al. |
| 4,364,065 | A | 12/1982 | Yamamori et al. |
| 4,571,601 | A | 2/1986 | Teshima |
| 4,746,938 | A | 5/1988 | Yamamori et al. |
| 4,947,187 | A | 8/1990 | Iwagami |
| 5,300,958 | A | 4/1994 | Burke et al. |

(Continued)

FOREIGN PATENT DOCUMENTS

| | | | |
|---|---|---|---|
| DE | 102011002727 | A1 | 7/2012 |
| EP | 1 827 839 | B1 | 2/2009 |

(Continued)

OTHER PUBLICATIONS

Kwon et al., "Measurement of Inkjet First-Drop Behavior Using a High-Speed Camera," Review of Scientific Instruments; vol. 87, Issue 3, 2016, AIP Publishing, pp. 1-11.

(Continued)

*Primary Examiner* — Justin Seo
(74) *Attorney, Agent, or Firm* — Gibb & Riley, LLC

(57) ABSTRACT

A cap is positioned to contact a printhead when the printhead is not ejecting liquid ink. The cap and the printhead create a sealed space adjacent printhead nozzles when contacting each other. A heated evaporator is connected to the cap and is adapted to evaporate an ink-compatible liquid to form a water and/or solvent vapor and supply the water and/or solvent vapor to the sealed space to protect the liquid ink in the nozzles. An insulator thermally insulates the heated evaporator from the printhead. This prevents the ink in the nozzles from drying and prevents the nozzles from clogging.

17 Claims, 7 Drawing Sheets

(56) References Cited

U.S. PATENT DOCUMENTS

| | | | | |
|---|---|---|---|---|
| 5,394,178 | A | 2/1995 | Grange | |
| 5,412,411 | A | 5/1995 | Anderson | |
| 5,635,965 | A | 6/1997 | Purwins et al. | |
| 5,663,751 | A | 9/1997 | Holbrook | |
| 5,670,997 | A | 9/1997 | Sugimoto et al. | |
| 5,726,692 | A | 3/1998 | Yamaguchi et al. | |
| 5,936,647 | A | 8/1999 | Rhodes et al. | |
| 5,949,448 | A | 9/1999 | Man et al. | |
| 5,980,622 | A | 11/1999 | Byers | |
| 6,106,098 | A | 8/2000 | Nakamura et al. | |
| 6,135,585 | A | 10/2000 | Johnson et al. | |
| 6,508,533 | B2 | 1/2003 | Tsujimoto et al. | |
| 6,578,947 | B1 | 6/2003 | Suwabe et al. | |
| 6,726,304 | B2 | 4/2004 | Fassler et al. | |
| 7,156,514 | B2 | 1/2007 | Rosa | |
| 7,753,475 | B2 | 7/2010 | Berry et al. | |
| 7,810,899 | B2 | 10/2010 | Usui et al. | |
| 7,992,986 | B2 | 8/2011 | Snyder et al. | |
| 8,592,503 | B2 | 11/2013 | Bogale et al. | |
| 2001/0026299 | A1 | 10/2001 | Tsujimoto et al. | |
| 2002/0180853 | A1 | 12/2002 | Ohsawa et al. | |
| 2003/0227505 | A1 | 12/2003 | Tanaka et al. | |
| 2003/0231222 | A1 | 12/2003 | Jefferson et al. | |
| 2004/0183879 | A1* | 9/2004 | Nakazawa | B41J 11/007 347/101 |
| 2006/0119645 | A1 | 6/2006 | Berry et al. | |
| 2006/0164460 | A1 | 7/2006 | Uwagaki et al. | |
| 2006/0274110 | A1 | 12/2006 | Kang et al. | |
| 2007/0046721 | A1 | 3/2007 | Miyazawa | |
| 2007/0076045 | A1 | 4/2007 | James et al. | |
| 2007/0085875 | A1 | 4/2007 | Shimazaki et al. | |
| 2007/0252863 | A1 | 11/2007 | Sun et al. | |
| 2007/0263026 | A1 | 11/2007 | Shang et al. | |
| 2008/0018677 | A1 | 1/2008 | White et al. | |
| 2008/0024532 | A1 | 1/2008 | Kim | |
| 2008/0204501 | A1 | 8/2008 | Kurita et al. | |
| 2009/0174748 | A1 | 7/2009 | Balcan et al. | |
| 2009/0237424 | A1 | 9/2009 | Martin et al. | |
| 2010/0073445 | A1 | 3/2010 | Silverbrook et al. | |
| 2011/0080443 | A1 | 4/2011 | Terame | |
| 2012/0162311 | A1 | 6/2012 | Taira | |
| 2013/0215189 | A1 | 8/2013 | Justice et al. | |
| 2014/0253633 | A1 | 9/2014 | Kobayashi et al. | |
| 2017/0072720 | A1 | 3/2017 | Yamagishi | |
| 2017/0203573 | A1 | 7/2017 | Hiramoto | |
| 2018/0079217 | A1 | 3/2018 | Hiratsuka et al. | |
| 2018/0244048 | A1 | 8/2018 | Ito | |
| 2018/0311986 | A1 | 11/2018 | Moriyama | |

FOREIGN PATENT DOCUMENTS

| | | | |
|---|---|---|---|
| JP | 4937785 | B2 | 5/2012 |
| KR | 10-1397307 | B1 | 5/2014 |
| WO | 2008026417 | A1 | 3/2008 |

OTHER PUBLICATIONS

U.S. Appl. No. 16/272,048, Notice of Allowance dated Oct. 15, 2020, pp. 1-10.

* cited by examiner

CAP AND EVAPORATIVE DEVICES STABILIZING INK IN NOZZLES OF INKJET PRINTHEADS

BACKGROUND

Systems and methods herein generally relate to inkjet printers and more particularly to printhead caps that include heated evaporative water and/or solvent vapor generating devices that stabilize ink in nozzles of inkjet printheads.

Inkjet printers eject drops of liquid marking material (e.g., ink) from nozzles or "jets" of printheads in patterns to perform printing. These nozzles of the inkjet printheads routinely clog when such are unused for extended periods, for example when an inkjet printer does not print for an extended period, or when certain colors or nozzles go unused for an extended period.

This can result in nozzles that do not eject any ink, or that only eject a significantly reduced drop mass, which causes less than optimal pixel placement ("streaky" solid-fill images) and lower than target drop mass (lighter than target solid-densities). If the condition goes uncorrected, it can lead to intermittent firing and the jet can eventually cease firing, and such a situation can be un-recoverable resulting in irreversible print head damage. Depending on the pre-condition of the head, the time scale for onset of such un-recoverable failure could range from a few hours to an overnight/weekend idle time.

Additionally, certain colors (e.g., magenta, etc.) are more susceptible to clogging relative to other colors, because certain color inks dry faster than other color inks, which causes the ink to dry in the nozzles of the printhead during extended inactivity. Such nozzle clogging issues can be mitigated, but not avoided, by purge and cleaning cycles.

SUMMARY

In order to address such issues, exemplary apparatuses herein include, among other components, a printhead that includes nozzles that are adapted to eject liquid ink, and a cap positioned to contact the printhead when the printhead is not ejecting the liquid ink. The cap and the printhead create a sealed space adjacent the nozzles when contacting each other.

Additionally, a heated evaporator is connected to the cap and is adapted to evaporate an ink-compatible liquid to form a water and/or solvent vapor. The ink-compatible liquid can be the same ink that is used for printing in the printhead, or a chemically similar material (e.g., possibly water and/or solvent, but without the colorants, cleaning solution, etc.) The water and/or solvent vapor is supplied to the sealed space without spraying the ink-compatible liquid directly on the nozzles. For example, the heated evaporator can be a container containing the ink-compatible liquid from which the ink-compatible liquid evaporates (that is connected to the cap by a supply line), an atomizer (that can be heated or not) that provides fine droplets of the ink-compatible liquid into the sealed space, etc. A heater can be connected to, or a component of, the heated evaporator. A reservoir can be part of or connected to the heated evaporator and can be adapted to store the ink-compatible liquid prior to it being heated. The heated evaporator is thermally insulated from at least the printhead by one or more insulator layers/structures.

A heater control can be connected to, or a component of, the heated evaporator. The heater control is adapted to prevent the heated evaporator from heating the ink-compatible liquid to a temperature that vaporizes the ink-compatible liquid when the cap is not contacting the printhead. The heater control can be adapted to control the heated evaporator to supply different amounts of the water and/or solvent vapor to different color printheads; and supply the water and/or solvent vapor to the sealed space only after an idle time period (during which the nozzles do not eject the liquid ink) has expired; etc.

Various methods herein position the printhead and the cap to contact one another to create the sealed space between the cap and nozzles of the printhead. Again, the nozzles are adapted to maintain liquid ink. As noted previously, such methods evaporate an ink-compatible liquid to form a water and/or solvent vapor and supply the water and/or solvent vapor to the sealed space. While many different processes can be used to perform the evaporation, some methods herein can activate the heater control of the heated evaporator (while keeping the heater thermally insulated from the printhead), activate the atomizer, etc. Further, these methods can supply different amounts of the water and/or solvent vapor to different color printheads. Also, the ink-compatible liquid can be supplied to the sealed space only after an idle time period (during which the nozzles do not eject the liquid ink) has expired.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, nozzles of inkjet printheads routinely clog when such are unused for extended periods, and purge and cleaning cycles are not completely effective at preventing clogs. In view of such issues, apparatuses herein maintain a water and/or solvent vapor atmosphere around the nozzles during extended printhead storage to stabilize ink in nozzles of inkjet printheads and prevent nozzle clogging.

More specifically, structures herein include inkjet printhead resting/parking devices that have a cap that covers the inkjet printhead when not in use, and the cap creates a sealed space around the nozzles. The cap device includes a heated evaporator that evaporates an ink-compatible liquid (ink, solvents, co-solvents, water, cleaning solution, etc.) to form a water and/or solvent vapor that is supplied to the sealed space via supply lines, atomizers, etc. The water and/or solvent vapor prevents the ink in the nozzles from drying out and thereby prevents nozzle clogging/blocking.

In greater detail, the water and/or solvent vapor that is formed on the nozzles is heated to a range of temperatures above the printhead temperature (e.g., 10° C.-40° C. above) or simply to an established temperature (e.g., 40° C., 80° C., 160° C., etc.) that is high enough to cause the ink-compatible liquid to evaporate and form the water and/or solvent vapor. The heated evaporator supplies a sufficient quantity of the water and/or solvent vapor to account for any leaks of the gases from the capping station. Further, the devices and methods herein thermally isolate at least the printhead from the heater so that only heated vapor reaches the printhead and to prevent drying the ink in the printhead. As the vapors condense on the sidewall and printhead faceplate they are allowed to gravity feed back to the reservoir of the heated evaporator to conserve the ink-compatible liquid.

Figure 1:
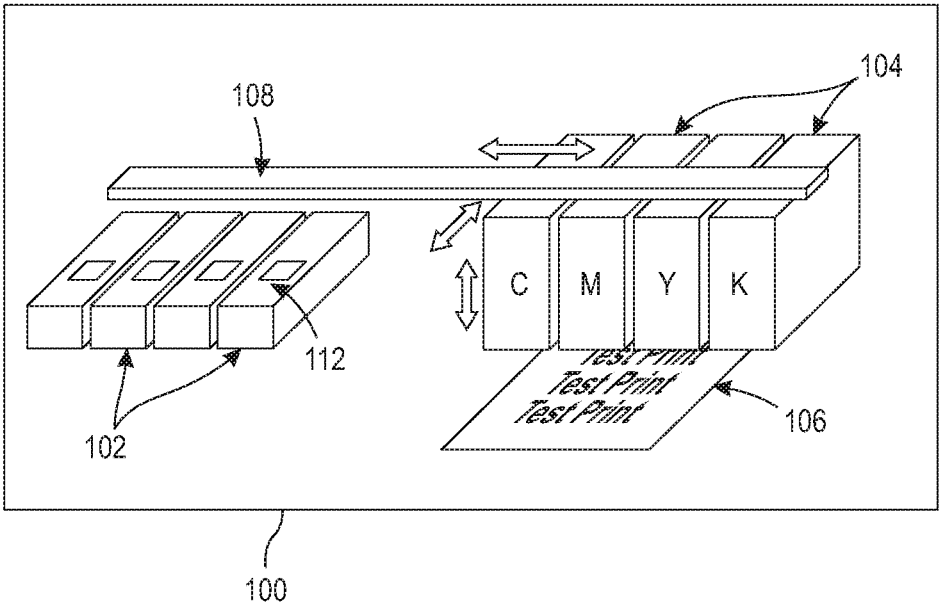
FIGS. 1 and 2 are perspective/exploded conceptual diagrams illustrating inkjet print cartridges and cartridge resting locations of structures herein.
Figure 2:
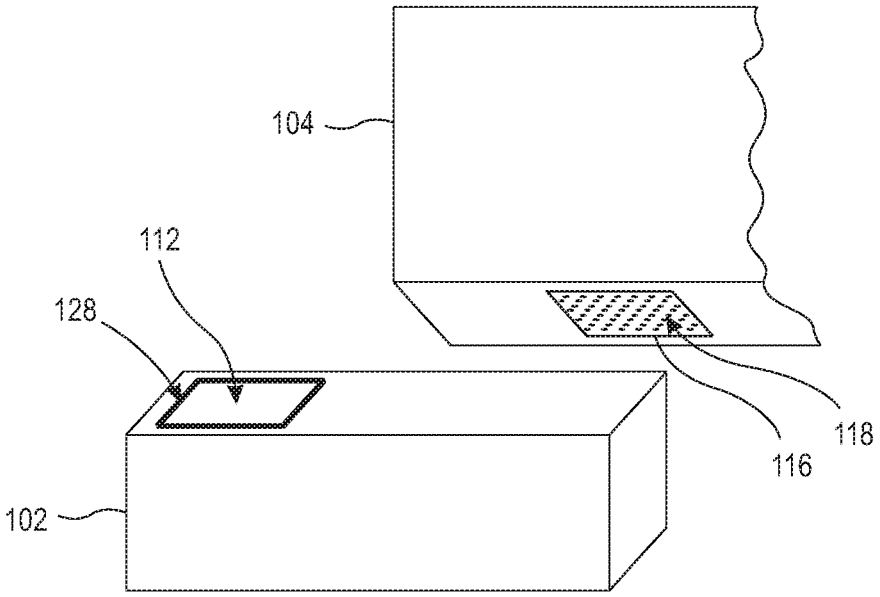

FIGS. 1 and 2 are perspective/exploded conceptual diagrams illustrating some components of an inkjet printing engine 100 that includes inkjet print cartridges 104 and cartridge resting structures 102. One or both of the cartridge resting structures 102 and the inkjet print cartridges 104 are movable along, for example, an actuator/track structure 108. In one example, the inkjet printer cartridges 104 are moved by the actuator/track structure 108 into a printing location to print markings on a sheet of print media 106. When not printing, the inkjet print cartridges 104 move to a "parked," "resting," or "home" position where they connect to a cap 112 of the cartridge resting structures 102. Note, as shown by the block arrows in FIG. 1, the actuator/track structure 108 can move the inkjet print cartridges 104 in many different directions.

The inkjet print cartridges 104 remain connected to the cartridge resting structures 102 unless the inkjet printing engine 100 is in the process of using the inkjet print cartridges 104 for printing. When printing markings on the sheet of print media 106, the ink jet printers 100 eject drops (fine droplets) of liquid marking material (e.g., ink, etc.) from nozzles 118 (jets) of inkjet printheads 116 in patterns to perform the printing on the print media 106. After printing, the inkjet print cartridges 104 again return to the cartridge resting structures 102.

Again, the nozzles 118 of such inkjet printheads routinely clog when such are unused for extended periods. In order to address such issues, apparatuses herein include the cap 112 as part of the cartridge resting structures 102. The cap 112 is positioned to contact (connect to or join with) the printhead 116 when the printhead 116 is not ejecting the liquid ink. The cap 112 includes a seal 128 so that the cap 112 and the printhead 116 create a sealed space 114 adjacent the nozzles 118 when contacting or connected to each other (e.g., when the printhead 116 is parked on or resting on the cap 112 in between printing operations).

Figure 3:
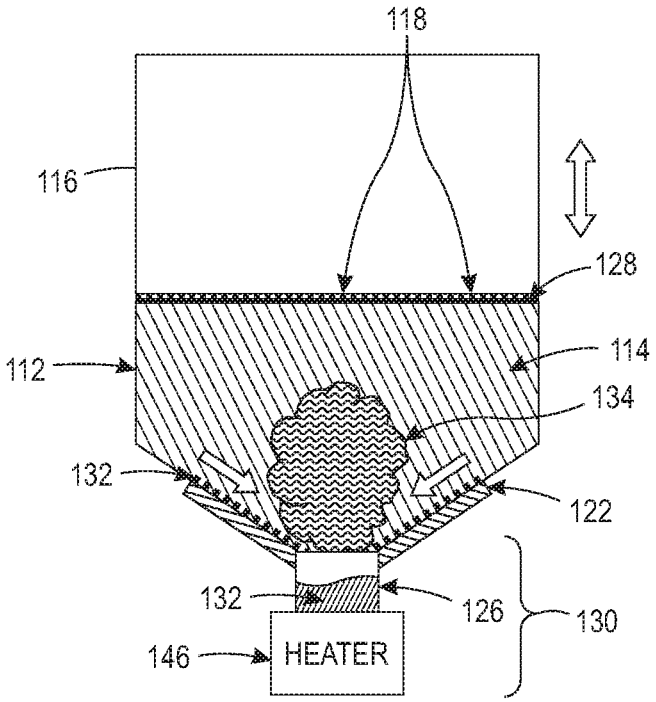
FIGS. 3-6 are enlarged cross-sectional views of a cap device and printhead of structures herein.
Figure 4:
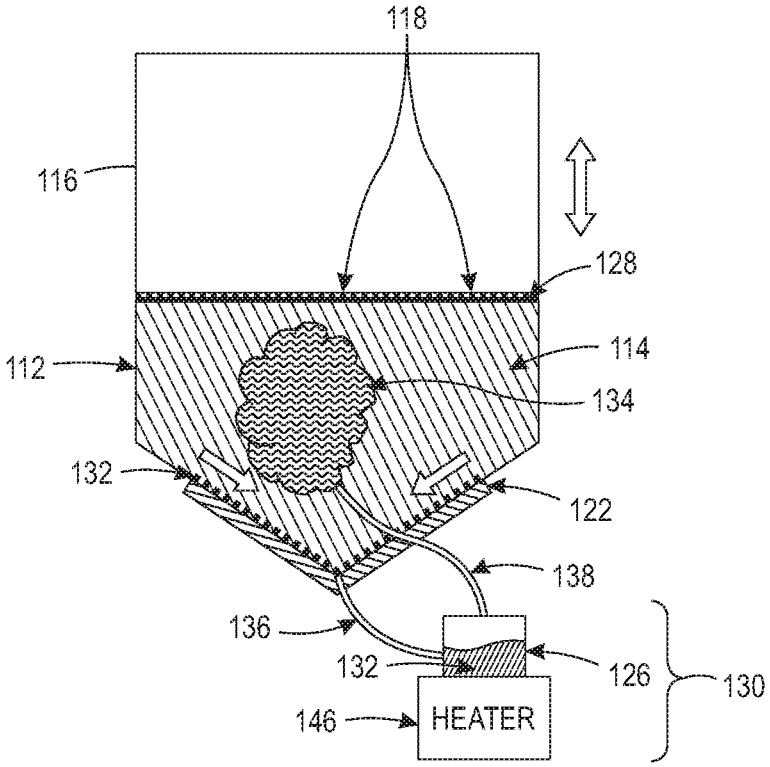

The sealed space 114 can be more easily seen in the enlarged cross-sectional views in FIGS. 3-6, which show one of the printheads 116 parked on (connected to) one of the cap devices 112. As can also be seen in FIGS. 3-6, a heated evaporator 130 is connected to the bottom of the cap 112 either directly (FIG. 3) or by a supply lines 138 (FIG. 4).

The heated evaporator includes a reservoir 126 maintaining the ink-compatible liquid 132, and an integral or separate heater 146 (which may include a heater controller). The heated evaporator 130 is adapted to evaporate the ink-compatible liquid 132 to create an ink-compatible vapor 134 within the sealed space 114. Again, the ink-compatible liquid 132 can be the same color ink that is used for printing in the printhead 116, or a chemically similar material (e.g., possibly water and/or solvents or co-solvents, without the colorants, cleaning solution, etc.) The water and/or solvent vapor 134 is supplied to the sealed space 114 without spraying the ink-compatible liquid directly on the nozzles 118.

FIG. 3 illustrates one exemplary structure in which the heated evaporator 130 includes the container 126 as part of the bottom of the cap device 112. The heater 146 is connected to and heats the part of the container 126 that is outside the cap device 112. In addition, thermal insulators 122 can line the outside of the bottom of the cap device 112 and the thermal insulators 122 are adapted to insulate the printhead 116 from the heat generated by the heater 146 to prevent heat generated by the heater 146 from drying out the ink in the nozzles 118.

With the structure shown in FIG. 3, any of the water and/or solvent vapor 134 that condenses on the sidewalls of the cap device 112 or on the printhead 116 can travel down the cap device 112 (as indicated by the block arrows in FIG. 3) returns by gravity to the container 126 which can be open to the interior of the cap device 112. Further, if the ink-compatible liquid 132 is the same as the ink used within the printhead 116, the container 126 can be filled and refilled with the ink-compatible liquid 132 by ejecting ink from the nozzles to allow the ink to travel down the cap device 112 into the container 126.

FIG. 4 illustrates an alternative structure that is similar to the structure shown in FIG. 3; however, in FIG. 4, the heated evaporator 130 is physically separate from the printhead 116 (to provide even greater thermal insulation from the heater 146) and is connected to the cap device 112 by supply lines 138. Therefore, in the structure shown in FIG. 4, the water and/or solvent vapor 134 is supplied from the heated evaporator 130 to the sealed space 114 of the cap device 112 through the supply lines 138. In addition, the structure shown in FIG. 4 includes a drain line 136 that allows the ink-compatible liquid 132 that condenses on, or is ejected upon, the sidewalls of the cap device 112 to drain back into the container 126 of the heated evaporator 130.

Figure 5:
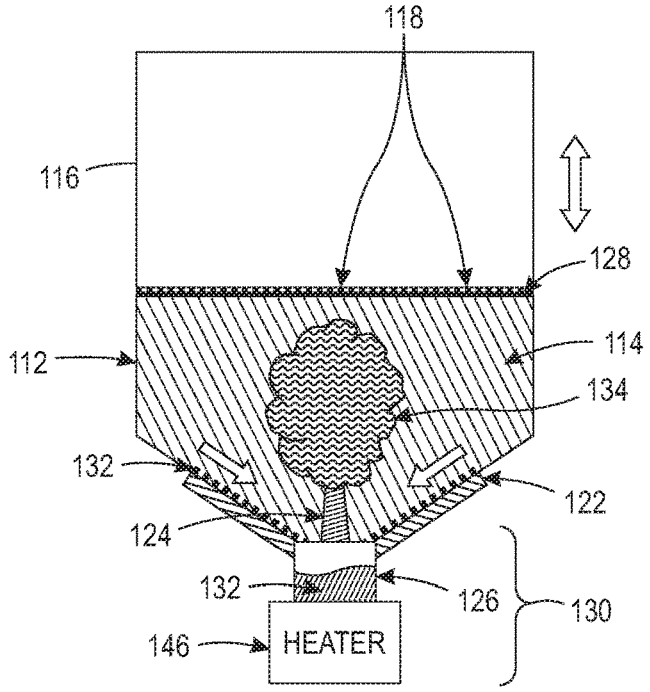
Figure 6:
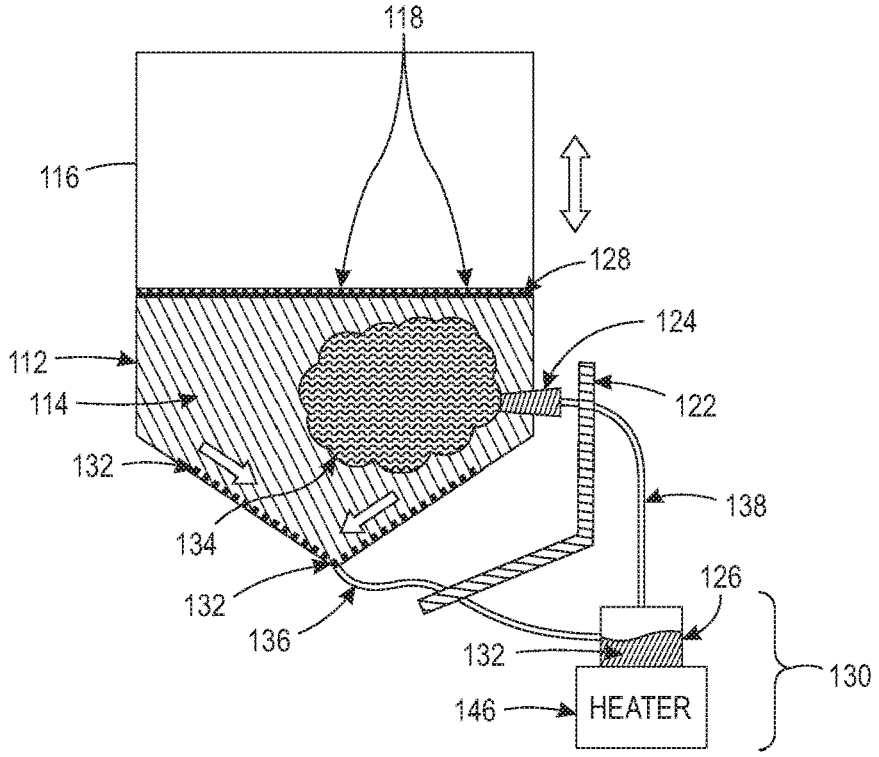

FIGS. 5 and 6 illustrate similar structures to those shown in FIGS. 3 and 4; however, in FIGS. 5 and 6, an atomizer 124 is used to atomize the ink-compatible vapor 134 inside the sealed space 114 of the cap device 112. The atomizer 124 produces fine droplets of the ink-compatible liquid 132 into the sealed space 114 to help vaporize any of the ink-compatible liquid 132 that the heated evaporator 130 failed to vaporize. As discussed above, while the container 126 forms part of the bottom of the cap device 112 in the structure in FIG. 5, in the structure in FIG. 6 the supply line 138 is used to supply the water and/or solvent vapor 134 to the atomizer 124, and the condensation again returns via the drain line 136.

In all of the structures shown in FIGS. 3-6, the seal 128 creates a closed system (either directly or through supply/drain lines 136, 138) between the sealed space 114 and the heated evaporator 130, which allows the heated evaporator 130 to maintain the same concentration of the water and/or solvent vapor 134 during the full storage time that the printhead 116 is parked or stored on the cap device 112. Additionally, depending upon the volatility of the ink-compatible liquid 132, the heater 146 can be optional (or optionally used) in the foregoing structures, so long as sufficient vapor pressure can be maintained on the ink in the nozzles 118 to prevent the ink from evaporating.

Further, the heated evaporator 130 can be adapted or controlled to prevent heating the ink-compatible liquid 132 when the cap 112 is not contacting the printhead 116. The heater control can be further adapted to control the heated evaporator 130 to supply different amounts of the water and/or solvent vapor 134 to different color printheads 116; and supply the water and/or solvent vapor 134 to the sealed space 114 in a delayed manor and only after an idle time period (during which the nozzles 118 do not eject the liquid ink) has expired; etc. Therefore, some color printheads may not receive the water and/or solvent vapor 136 as often as other color printheads.

Figure 7:
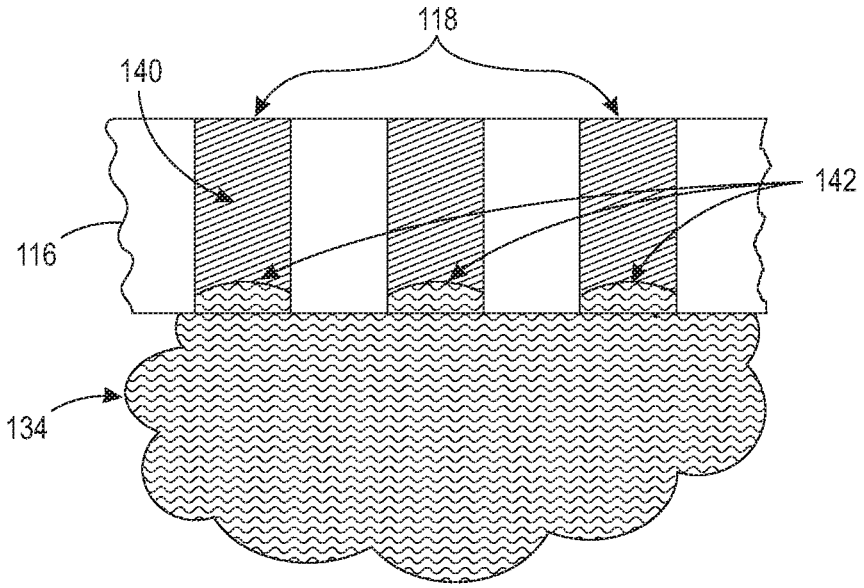
FIG. 7 is a cross-sectional conceptual diagram illustrating nozzles of inkjet print cartridge of structures herein.

FIG. 7 illustrates (in cross-section) a small portion of the inkjet printhead 116 and shows liquid ink 140 within a few of the nozzles 118. As noted above, methods and devices herein supply the water and/or solvent vapor 134 to an area adjacent the nozzles 118. This water and/or solvent vapor 134 provides pressure on the exposed surface of the ink 140 within the nozzles, preventing evaporation of the ink 140 from the nozzles. Again, as described above, a sufficient amount of vapor may be maintained by just natural spontaneous evaporations of the ink-compatible liquid 132, through heating, through atomization, etc., or any other manner that allows the vapor pressure to prevent the ink 140 in the nozzles 118 from evaporating and drying out.

Figure 8:
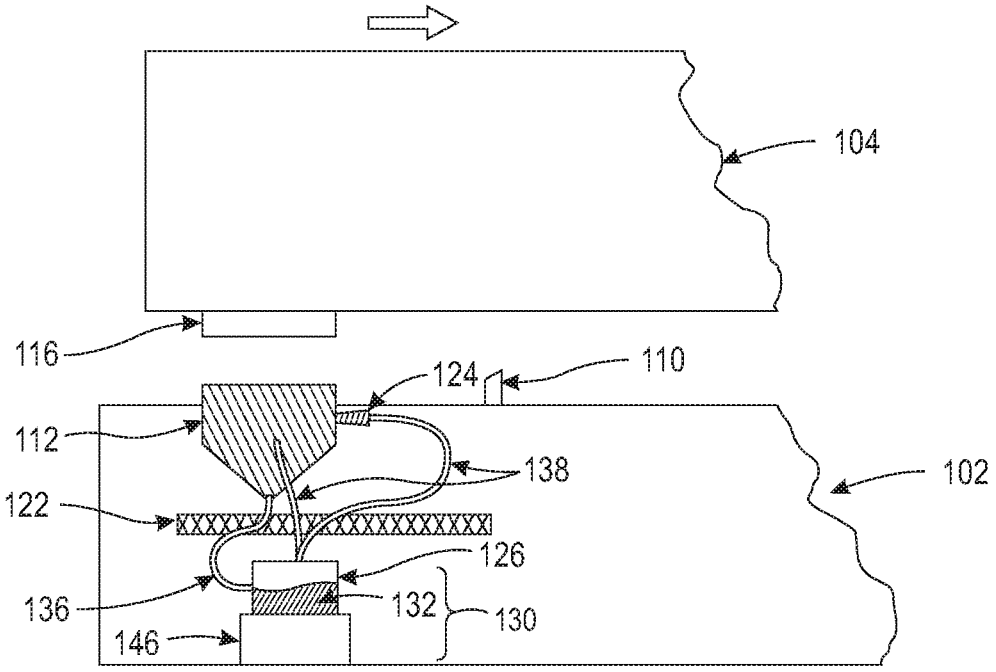
FIGS. 8-10 are cross-sectional views of a cap device and printhead of structures herein.
Figure 9:
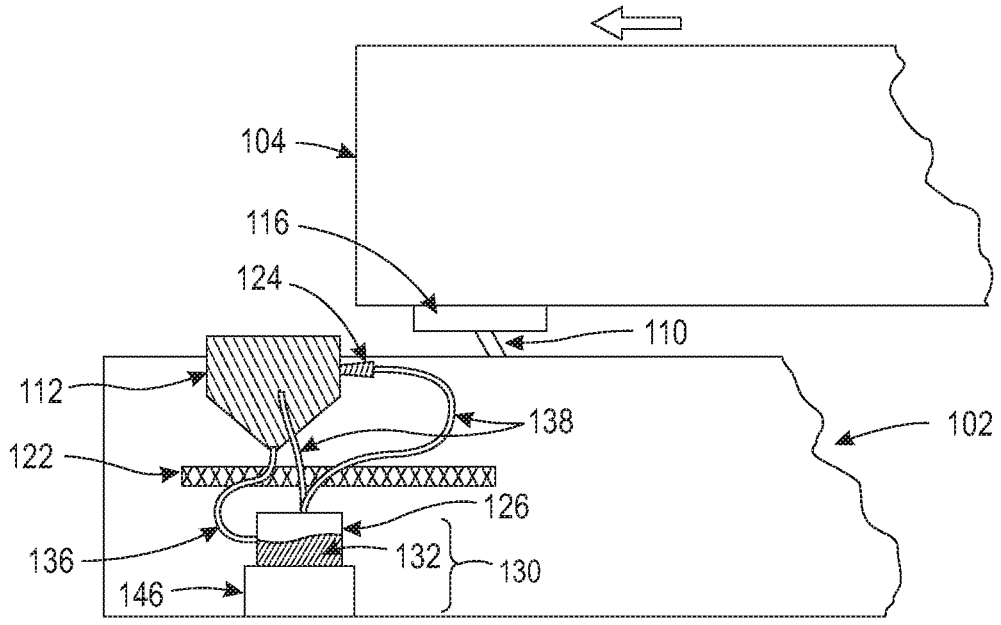
Figure 10:
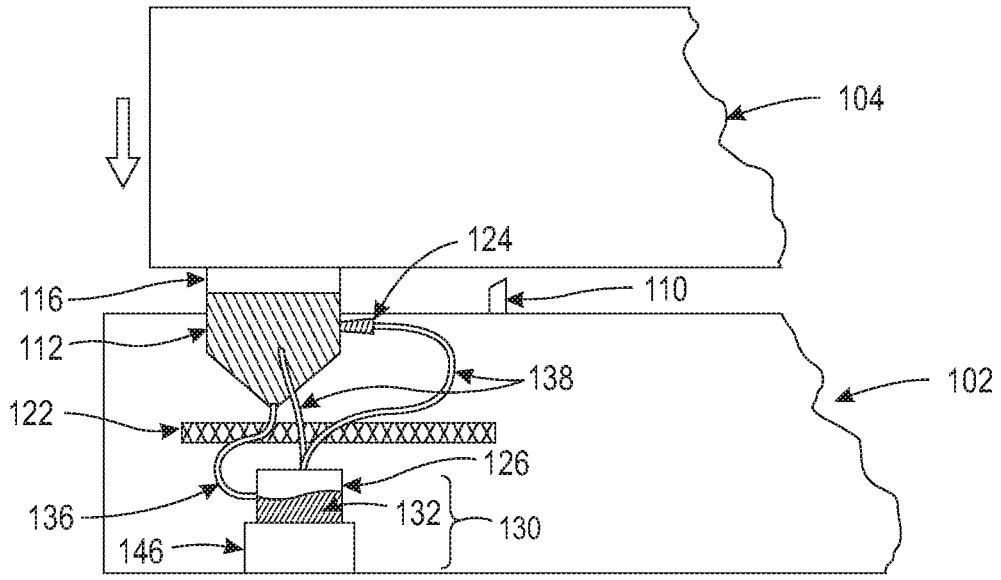

FIGS. 8-10 are cross-sectional diagrams that illustrate that the accumulated amount of the water and/or solvent vapor 134 can be periodically wiped from the printhead 116 to help keep the nozzles 118 clear during extended storage. More specifically, as shown in FIG. 8, the printhead 116 can be moved (by the actuator/track structure 108) toward a wiper 110 that can be part of the cartridge resting structure 102. As shown in FIG. 9, the printhead 116 can be moved to contact the wiper 110. As shown in FIG. 10, the printhead 116 can be moved to once again connect to the cap device 112 to again form the sealed space 114, after which the foregoing processing that forms the water and/or solvent vapor 134 can be repeated to keep the ink 140 in the nozzles 118 from drying out.

Figure 11:
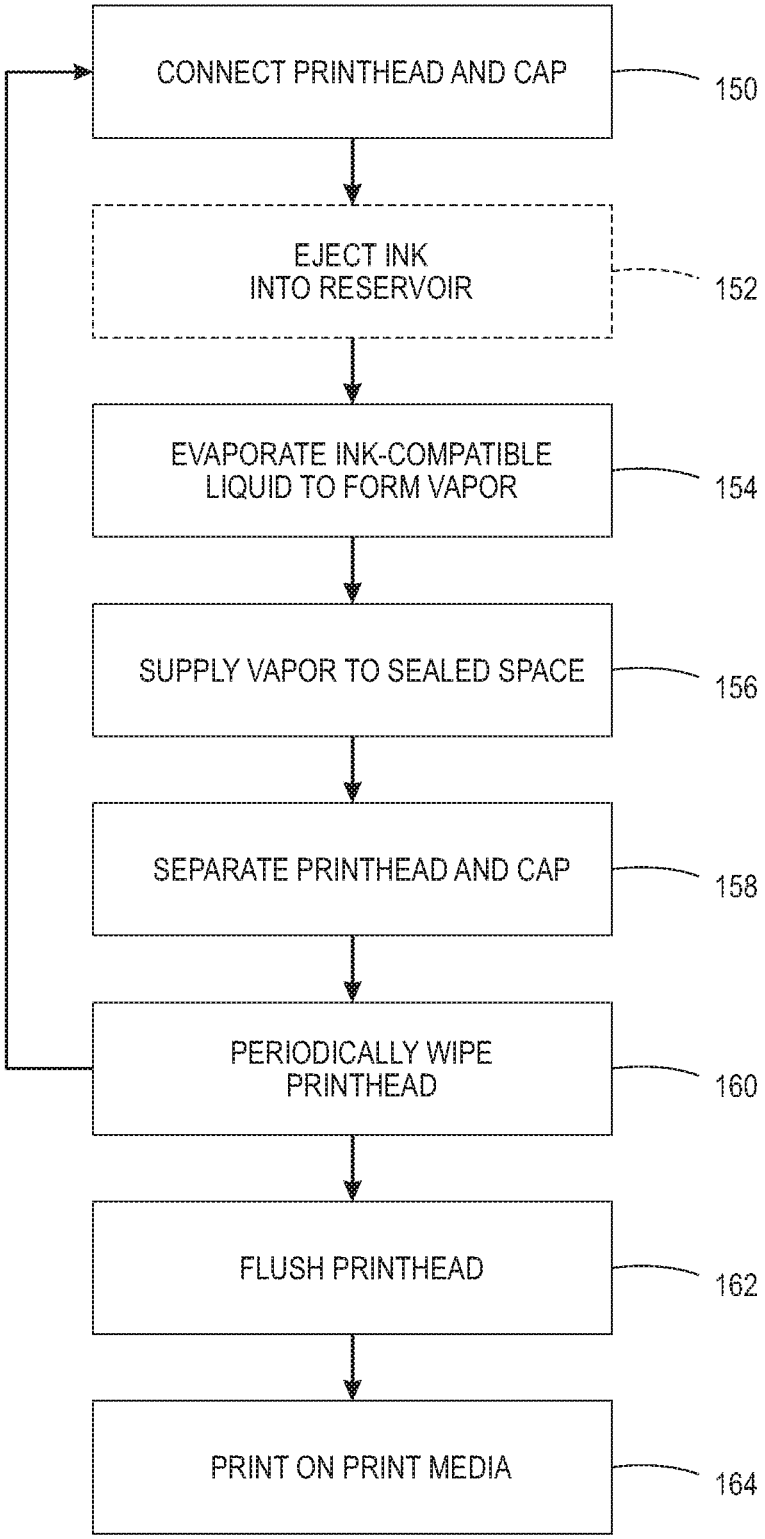
FIG. 11 is a flowchart illustrating methods herein.

FIG. 11 illustrates some aspects of various methods herein, where such methods position the printhead and the cap to contact or connect with one another (in item 150) to create the sealed space between the cap and nozzles of the printhead. While the ink-compatible liquid can be constantly supplied to the reservoir, if the ink-compatible liquid is the actual ink used in the printhead, in item 152, these methods can eject ink into the sealed space to supply the ink-compatible liquid to the reservoir of the heated evaporator. In the simplest example, no heater/reservoir may be used if the spontaneously vaporized ink itself can provide a sufficient vapor pressure to keep the ink in the nozzles from drying out, allowing just the ink to be simply ejected in a required quantity into the cap.

As noted previously, in item 154 such methods evaporate the ink-compatible liquid to form a water and/or solvent vapor. In item 156, these methods supply the water and/or solvent vapor to the sealed space (directly, through supply lines, through the atomizer, etc.). Further, in items 154-156, these methods can evaporate different amounts of the water and/or solvent vapor to different color printheads. Further, the ink-compatible liquid can be supplied to the sealed space in a delayed manor and only after an idle time period (during which the nozzles do not eject the liquid ink) has expired.

As shown in item 158, the printhead can be periodically removed from the cap device and in item 160 the methods herein can wipe the printhead before potentially returning the printhead to the cap device (as shown by the loop back to item 150). However, if printing is to resume, instead of returning the printhead to the cap device in item 150, instead processing proceeds to item 162 where the printhead is flushed. With the printhead now ready for printing, printing on print media is performed in item 164.

Therefore, with structures and methods herein, the vapor environment within the sealed space between the nozzles and the cap device keeps the water and/or solvent vapor on the liquid ink within the nozzles to protect the liquid ink during extended periods of non-printing.

Figure 12:
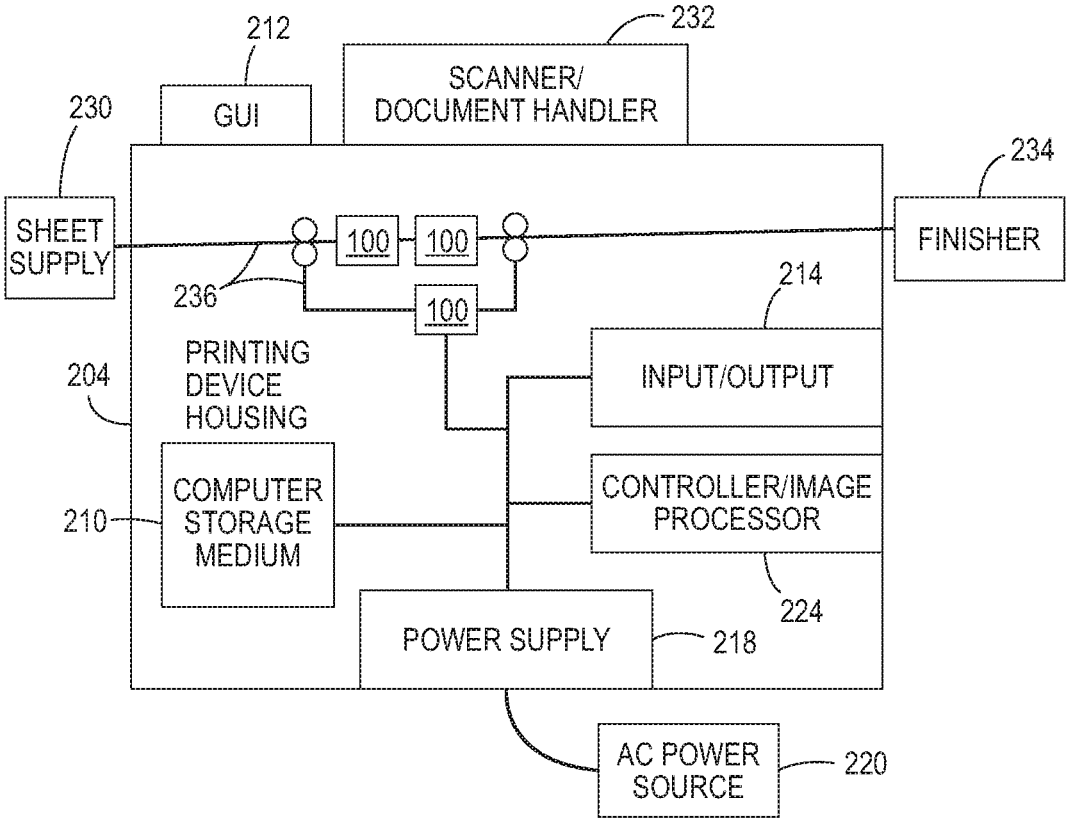
FIG. 12 is a conceptual diagram illustrating printing devices herein.

FIG. 12 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 12, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 100 that use marking material, and are operatively connected to a specialized image processor 224 (that may be different from a general purpose computer because it is specialized for processing image data), a media path 236 positioned to supply continuous media or sheets of media from a sheet supply 230 to the marking device(s) 100, etc. After receiving various markings from the printing engine(s) 100, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 100 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 100 can include, for example, inkjet printheads, contact printheads, three-dimensional printers, etc.

As noted above, the water and/or solvent vapor 134 amount in the sealed space 114 can be maintained at different levels for different printheads, different inks, different colors, different print bars, etc. When printheads, inks, colors, etc., are installed in a printer, the controller 224 is made aware of the printer's components. Therefore, the controller 224 can control the heated evaporator 130 to: supply different amounts of water and/or solvent vapor 134 to the different color printheads 116 within the printer; supply water and/or solvent vapor 134 to the sealed space in a delayed process and only after an idle time period that is specific to the ink or printheads within the printer has expired, etc.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

a cap positioned to contact a printhead, comprising nozzles adapted to eject liquid ink, when the printhead is not ejecting the liquid ink, wherein the cap and the printhead create a sealed space adjacent the nozzles when contacting each other;

a heated evaporator connected to the cap and adapted to evaporate an ink-compatible liquid into the sealed space and form a vapor and supplying the vapor to the sealed space;

a controller connected to the heated evaporator adapted to control the heated evaporator to supply the vapor to the sealed space only after an idle time period, during which the nozzles do not eject the liquid ink, has expired, and a thermal insulator positioned between the printhead and the heated evaporator.

2. The apparatus according to claim 1, wherein the heated evaporator comprises a heater external to the cap.

3. The apparatus according to claim 1, further comprising a supply line connected to the heated evaporator, wherein the supply line supplies the vapor from the heated evaporator to the sealed space.

4. The apparatus according to claim 1, further comprising a controller connected to the heated evaporator adapted to control the heated evaporator to supply different amounts of the vapor to different color printheads.

5. The apparatus according to claim 1, wherein the heated evaporator is adapted to avoid spraying the ink-compatible liquid directly on the nozzles.

6. The apparatus according to claim 1, further comprising a reservoir operatively connected to the heated evaporator and adapted to supply the ink-compatible liquid to the heated evaporator.

7. An apparatus comprising:

a printhead comprising nozzles adapted to eject liquid ink;

a cap positioned to contact the printhead when the printhead is not ejecting the liquid ink, wherein the cap and the printhead create a sealed space adjacent the nozzles when contacting each other;

a heated evaporator connected to the cap and adapted to evaporate an ink-compatible liquid into the sealed space and form a vapor and supplying the vapor to the sealed space a controller connected to the heated evaporator adapted to control the heated evaporator to supply the vapor to the sealed space only after an idle time period, during which the nozzles do not eject the liquid ink, has expired;

a thermal insulator positioned between the printhead and the heated evaporator; and a heater control connected to the heated evaporator, wherein the heater control is adapted to prevent the heated evaporator from heating the ink-compatible liquid to a temperature that vaporizes the ink-compatible liquid when the cap is not contacting the printhead.

8. The apparatus according to claim 7, wherein the heated evaporator comprises a heater external to the cap.

9. The apparatus according to claim 7, further comprising a supply line connected to the heated evaporator, wherein the supply line supplies the vapor from the heated evaporator to the sealed space.

10. The apparatus according to claim 7, further comprising a controller connected to the heated evaporator adapted to control the heated evaporator to supply different amounts of the vapor to different color printheads.

11. The apparatus according to claim 7, wherein the heated evaporator is adapted to avoid spraying the ink-compatible liquid directly on the nozzles.

12. The apparatus according to claim 7, further comprising a reservoir operatively connected to the heated evaporator and adapted to supply the ink-compatible liquid to the heated evaporator.

13. A method comprising:

positioning a printhead and a cap to contact one another to create a sealed space between the cap and nozzles of the printhead, wherein the nozzles are adapted to maintain liquid ink; and heating an ink-compatible liquid to form a vapor; and supplying the vapor to the sealed space, wherein the ink-compatible liquid is supplied to the sealed space only after an idle time period, during which the nozzles do not eject the liquid ink, has expired.

14. The method according to claim 13, wherein the heating comprises activating a heater of a heated evaporator that is insulated from the printhead.

15. The method according to claim 13, wherein the heating comprises heating the ink-compatible liquid to a temperature that vaporizes water and/or solvent contained in the ink-compatible liquid.

16. The method according to claim 13, wherein the heating is performed outside the sealed space.

17. The method according to claim 13, further comprising supplying different amounts of the vapor to different color printheads.

* * * * *